United States Patent [19]

Singer

[11] 4,190,979

[45] Mar. 4, 1980

[54] TOY SLEIGH

[76] Inventor: Monroe J. Singer, 9000 SW. 64th St., Miami, Fla. 33173

[21] Appl. No.: 967,644

[22] Filed: Dec. 7, 1978

[51] Int. Cl.[2] ..... A63H 33/06

[52] U.S. Cl. ..... 46/17; 46/1 R; 280/12 R

[58] Field of Search ..... 46/1 R, 16, 17, 201, 46/222, 223; 280/12 A, 12 C, 12 R, 27; 428/17, 21, 24; D12/6, 9

[56] References Cited

U.S. PATENT DOCUMENTS

| | | | |
|---|---|---|---|
| D. 187,035 | 1/1960 | Singer | D12/6 |
| 665,184 | 1/1901 | Creighton | 280/12 R |
| 2,022,179 | 11/1935 | Blackmore | 46/201 X |
| 3,315,925 | 4/1967 | Pawl | 428/21 X |
| 3,553,887 | 1/1971 | Linstead | 46/223 |

*Primary Examiner*—Louis G. Mancene
*Assistant Examiner*—Mickey Yu
*Attorney, Agent, or Firm*—Salvatore G. Militana

[57] ABSTRACT

A toy sleigh consisting of a body portion and a pair of runners each of which are separately produced and assembled, the body portion having a plurality of aligned bores in its bottom wall adjacent the side wall of the body portion, the bores receiving stem portions mounted on the runners, the stem portions having a boss forming a shoulder preventing the inadvertant sliding of the stem portions from the bores after the runners have been releasably secured to the body portion.

3 Claims, 5 Drawing Figures

TOY SLEIGH

BACKGROUND OF THE INVENTION

1. Field of the Invention

This invention relates to the structure of a toy sleigh and is more particularly directed to a toy sleigh having its runners releasably secured to the body of the sleigh.

2. Description of the Prior Art

In his U.S. Pat. No. D187,035, the applicant shows and claims the design of a sleigh consisting of a body portion and a pair of runners. The applicant produced the sleigh by a molding process in three parts and then cemented the runners permanently to the body portion. Once cemented, the various parts of the sleigh could not be dismantled without destroying the sleigh. Costs for shipping and storing the toy sleighs were high because of the larger size packages needed to house the assembled sleigh. The present invention contemplates avoiding the necessity to assemble the toy prior to shipping whereby the costs of shipping were low and the toy could then be assembled at the destination or by the person purchasing the toy.

SUMMARY OF THE INVENTION

Therefore, a principal object of the present invention is to provide a toy sleigh that is produced by a plastic injection molding process in a number of parts which may be readily assembled so that the storing and shipping of the parts results in a lesser cost of manufacture than if shipped and sold in an assembled condition.

Another object of the present invention is to provide a toy sleigh that is readily assembled and disassembled as desired by producing the sleigh in a number of interchangeable parts packaged in disassembled condition and assembled by the ultimate consumer or purchaser of the sleigh.

A still further object of the present invention is to provide a toy sleigh that is produced in a number of parts that can be replaced individually if a part concerned has to be replaced due to breakage, etc.

With these and other objects in view, the invention will be best understood from a consideration of the following detailed description taken in connection with the accompanying drawing forming a part of this disclosure, with the understanding, however, that the invention is not confined to any strict conformity with the showing of the drawing but may be changed or modified so long as such changes or modifications mark no material departure from the salient features of the invention as expressed in the appended claims.

Figure 2:
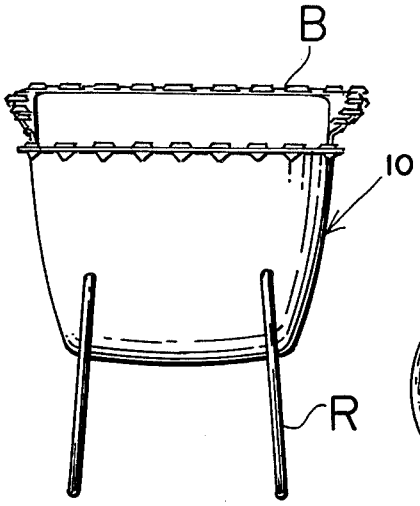
FIGS. 2 and 3 are front elevational and top plan views respectively.
Figure 1:
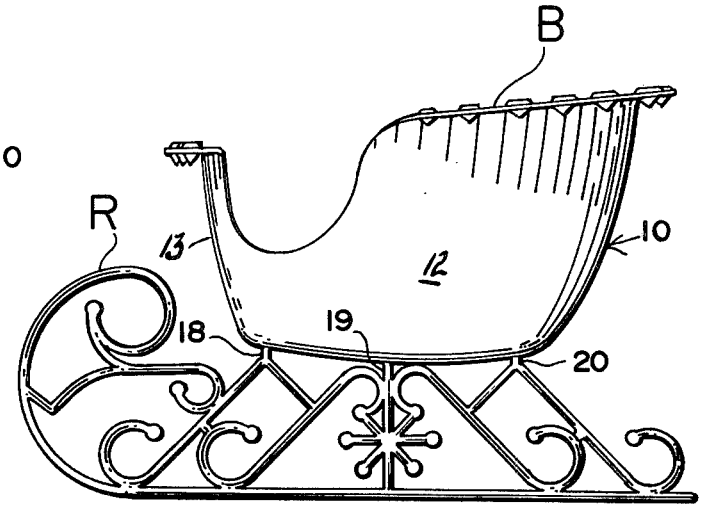
FIG. 1 is a side elevational view of a toy sleigh constructed in accordance with my invention.
Figure 5:
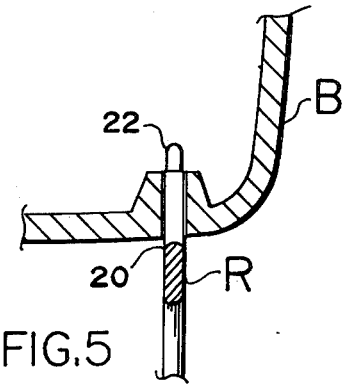
FIG. 5 is a cross sectional view taken along the line 5—5 of FIG. 4.
Figure 3:
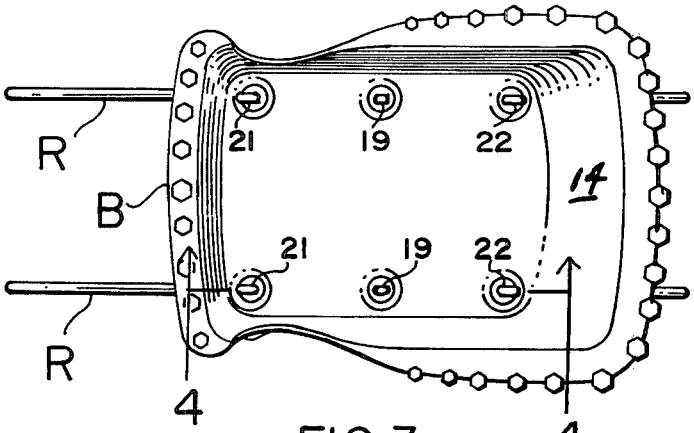

Referring to the drawing wherein like numerals are used to designate similar parts throughout the several views, the numeral 10 refers to my toy sleigh consisting of a body portion —B— mounted on a pair of runners —R— whose design is described and claimed in the U.S. Pat. No. D187,035, issued on Jan. 12, 1960. The present invention is an improvement of my design patent which is directed to the ornamental features thereof and shows the body and the runners as being of unitary structure. The improvement that forms the invention being described and claimed herein is directed to the separate structure of the body portion —B— and the runners —R— and the releasable securing of the runners —R— to the body portion —B—.

The body portion —B— consists of a bottom wall 11, side walls 12, a front wall 13 an a rear wall 14 formed as a unit by a plastic injection molding process. In the bottom wall 11 adjacent to each of the side walls 12 is a row of aligned openings 15, 16 and 17.

Figure 4:
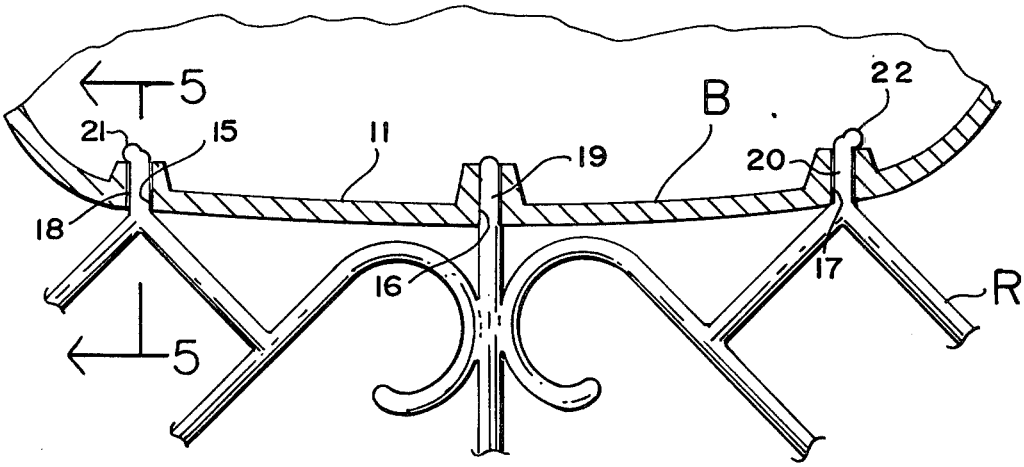
FIG. 4 is a cross sectional view taken along the line 4—4 of FIG. 3.

The runners —R— are each provided with a lattice work structure having three upright support members or stems 18, 19 and 20 that are received in the openings or bores 15, 16 and 17, respectively for supporting the runners —R— in an upright and vertical position as shown by FIGS. 2 and 4. Bosses 21 and 22 are provided on the free ends of the end two of the upright support members 18 and 20 that secure the latter against sliding out inadvertantly from the bores 15 and 17 and thereby retain the runners —R— in position on the body portion —B—. The stems or upright members 18, 19 and 20 are nothing more than an upright extension of the lattice work forming the runners and one of the same size in cross sectional shape as the openings 15, 16 and 17 so as to be easily threaded therethrough.

The bosses 21 and 22 are likewise of the same dimensions as their stems 18 and 20, they are mounted at an angle to the stems and to the axis of the bores 15 and 17 whereby when the stems 18, 19 and 20 are inserted into the bores 15, 16 and 17, the bosses 21 and 22 form a shoulder that engages the inner surface of the body portion —B— at the openings 15 and 17 respectively to thereby prevent the runners —R— from becoming separated from the body portion —B—. The bosses 21 and 22 that extend at an angle in a direction away from each other are sufficiently flexible that they are readily flexed into aligned position with the stems 18 and 20 when inserted into the openings 15 and 17 and resiliently return to their normally non-aligned position when in assembled position as shown by FIG. 4.

What I claim as new and desire to secure by Letters Patent is:

1. In a toy sleigh having a body portion and a pair of runners and said body portion having a bottom wall and plurality of side walls joining said bottom wall, the combination comprising a plurality of substantially aligned bores adjacent to said side walls, said runners having a plurality of substantially aligned stems extending through said bores and a boss mounted on the free end of said stems forming a shoulder engaging the inner surface of said bottom wall whereby said runners are releaseably secured to said body portion.

2. The structure as recited by claim 1 wherein said bosses extend at an angle to the axis of said bores.

3. The structure as recited by claim 2 wherein said bosses mounted on said stems of each of said runners extend in direction away from each other.

* * * * *